US007938932B2

(12) United States Patent
Hermans et al.

(10) Patent No.: US 7,938,932 B2
(45) **Date of Patent: *May 10, 2011**

(54) TISSUE SHEETS HAVING GOOD STRENGTH AND BULK

(75) Inventors: Michael Alan Hermans, Neenah, WI (US); Cristina Asensio Mullally, Neenah, WI (US); Stephanie Lee Berube, Greenville, WI (US); Frank Stephen Hada, Appleton, WI (US); Lacey Leigh Hansen, Neenah, WI (US); Jeffrey David Mathews, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/871,036

(22) Filed: Aug. 30, 2010

(65) Prior Publication Data

US 2010/0319863 A1 Dec. 23, 2010

Related U.S. Application Data

(60) Continuation of application No. 12/218,468, filed on Jul. 15, 2008, now Pat. No. 7,807,022, which is a division of application No. 10/980,735, filed on Nov. 2, 2004, now Pat. No. 7,419,569.

(51) Int. Cl.
*D21H 27/02* (2006.01)
*D21H 27/40* (2006.01)

(52) U.S. Cl. ..... 162/111; 162/113; 162/116; 428/153

(58) Field of Classification Search ..... 162/109–117; 428/152–154

See application file for complete search history.

(56) References Cited

U.S. PATENT DOCUMENTS 7,807,022 B2 * 10/2010 Hermans et al. ..... 162/113
2005/0252626 A1 * 11/2005 Chen et al. ..... 162/125

* cited by examiner

*Primary Examiner* — Eric Hug
(74) *Attorney, Agent, or Firm* — Michael J. Sullivan

(57) ABSTRACT

A method of making soft, strong, high bulk tissue is disclosed. The method includes pre-conditioning a wet web by straining the wet web in the cross-machine direction prior to transferring the wet web to a throughdrying fabric. The preconditioned web provides improved sheet softness and conforms more readily to the surface contour of the throughdrying fabric, thereby creating greater caliper (bulk) in the resulting dried sheet. The bulk is maintained during a subsequent creping step by maintaining the dried sheet in registration with the throughdrying fabric when the dried sheet is applied to the surface of the creping cylinder.

10 Claims, 1 Drawing Sheet

TISSUE SHEETS HAVING GOOD STRENGTH AND BULK

This application is a continuation of application Ser. No. 12/218,468 filed on Jul. 15, 2008, now U.S. Pat. No. 7,807,022, which is a divisional of application Ser No. 10/980,735 filed on Nov. 2, 2004, now U.S. Pat. No. 7,419,569. The entirety of application Ser. Nos. 10/980,735 and 12/218,468 are hereby incorporated by reference.

BACKGROUND OF THE INVENTION

Uncreped throughdried tissue manufacturing methods are capable of extremely high production rates when producing single-ply products such as towels and bathroom tissue. Softness is achieved by proper selection of fibers, layering, highly-contoured throughdrying fabrics and heavily calendering the resulting sheet. While such products are commercially successful, much of the bulk realized on the tissue machine is lost during calendering. As a result, there is still a need to further improve the softness of such sheets. By comparison, conventional creped throughdried tissue sheets are generally soft, but they lack the bulk and processing flexibility associated with uncreped throughdried processes.

Therefore there is a need for an improved tissue making process that provides a tissue sheet having a combination of high bulk, good strength and a high degree of softness.

SUMMARY OF THE INVENTION

It has now been discovered that an improved tissue product can be produced by selectively combining certain aspects of an uncreped throughdried tissue making process and a creped tissue making process. The resulting product is particularly soft, while maintaining good strength and bulk.

Hence in one aspect, the invention resides in a method of making a paper sheet comprising: (a) depositing an aqueous suspension of papermaking fibers onto a forming fabric to form a wet web; (b) dewatering the web to a consistency of about 20 percent or greater; (c) transferring the dewatered web to a three-dimensional transfer fabric, whereby the wet web is molded to the transfer fabric and thereby strained in the cross-machine direction; (d) transferring the strained web to a throughdrying fabric, whereby the strained web is conformed to the surface contour of the throughdrying fabric; (e) throughdrying the web to about 7 weight percent moisture or less while supported by the throughdrying fabric to form a paper sheet; (f) transferring the sheet to a creping cylinder while maintaining registration with the throughdrying fabric; and (g) creping the sheet.

In another aspect, the invention resides in a tissue sheet having a geometric mean slope (hereinafter defined) of from about 1.0 to about 3.5 kilograms of force per 3 inches of sample width (kg), a geometric mean tensile strength (hereinafter defined) of from about 350 to about 900 grams per 3 inches of sample width and a bulk (hereinafter defined) of from about 13 to about 22 cubic centimeters per gram.

During wet molding of the web, the wet web conforms to the top surface of the supporting transfer fabric and is strained into a three-dimensional form corresponding to the three-dimensional topography of the top surface of the transfer fabric. In the method of this invention, the three-dimensionality of the transfer fabric, coupled with the conformity of the wet web to the surface contour of the transfer fabric and, preferentially, the use of differential speed (rush transfer), serves to substantially strain the wet web in the cross-machine direction. Such cross-machine directional wet web strain (sometimes referred to as "molding strain") serves to precondition the web to make it more conformable and thereby increase the subsequent degree of molding of the web into the throughdrying fabric. Depending on the topography of the throughdrying fabric, more complete molding of the web into the surface of the throughdrying fabric can increase the visual distinctiveness imparted to the final sheet by the throughdrying fabric topography as well as enhance ultimate sheet properties, such as increasing bulk and stretch and reducing stiffness. Increased pre-straining with high strain transfer fabrics also enables higher topography throughdrying fabrics to be utilized with acceptable process and product windows. Accordingly, for purposes of this invention, cross-machine directional molding strain imparted to the wet web by the transfer fabric can be about 2 percent or greater, more specifically about 5 percent or greater, more specifically from about 2 to 20 percent, more specifically from about 5 to about 20 percent, more specifically from about 5 to about 15 percent, and still more specifically from about 10 to about 15 percent.

For the tissue sheets of this invention, the geometric mean slope can be from about 1.0 to about 3.5 kg, more specifically from about 1.5 to about 3.5 kg, more specifically from about 2.0 to about 3.5 kg, more specifically from about 2.0 to about 3.0 kg and still more specifically from about 2.2 to about 3.0 kg. The geometric mean tensile strength can be from about 350 to about 900 grams per 3 inches, more specifically from about 350 to about 800 grams per 3 inches, more specifically from about 375 to about 700 grams per 3 inches, and still more specifically from about 400 to about 700 grams per 3 inches. The bulk can be from about 13 to about 22 cubic centimeters per gram, more specifically from about 14 to about 21 cubic centimeters per gram, and still more specifically from about 15 to about 20 cubic centimeters per gram.

The basis weight of the tissue sheets of this invention can be from about 10 to about 40 grams per square meter (gsm), more specifically from about 15 to about 40 gsm, more specifically from about 20 to about 40 gsm and still more specifically from about 20 to about 30 gsm. For any given process, lowering the basis weight of the sheet will lower the geometric mean slope value and related tensile strength properties.

As used herein to characterize the web-supporting surface of the transfer fabrics or throughdrying fabrics, the terms "topographic" or "three-dimensional" mean a textured surface topography having significant surface contour such that the web can undergo substantial molding strain when conformed to the surface of the fabric. Such textured surfaces have visually noticeable surface features having a significant z-directional component, such as bumps, ridges and valleys, and the like. The elevation or z-directional difference between the tops and bottoms of these features is about 0.15 millimeter or greater.

The forming operation can be any forming means that provides a web of papermaking fibers for subsequent dewatering to the desired consistency. Particularly suitable forming methods include twin-wire formers.

Dewatering of the newly-formed web can be carried out by conventional vacuum dewatering means. The dewatered web should be brought to a consistency of about 20 percent or greater, more specifically from about 20 to about 40 percent, and still more specifically from about 25 to about 35 percent. While it is ordinarily desirable to dewater the web as much as possible for purposes of drying energy efficiency, there is a trade-off in that webs of higher consistency are stiffer and more difficult to conform to the three-dimensional contour of the transfer fabric during the subsequent rush transfer step. It is also recognized that there is an optimum transfer consistency based on the ratio of cost between electrical energy used for the vacuum pumps and the cost of gas used for thermal drying in the through-air dryers.

The newly-formed web is then preferably rush-transferred to a transfer fabric. As used herein, "rush" transferring means transferring a web from one fabric to a slower moving fabric. The fabric speed differential, which is defined as the percentage difference in speed between the two fabrics, can be about 5 percent or greater, more specifically from about 5 to about 80 percent, more specifically from about 10 to about 80 percent, more specifically from about 10 to about 50 percent, more specifically from about 15 to about 40 percent and still more specifically from about 20 to about 35 percent. The rush transfer of the sheet from the forming fabric to the transfer fabric serves to impart machine-direction stretch to the ultimate sheet, as well as making the sheet more conformable.

As used herein, a "transfer" fabric is a papermaking fabric that carries the wet web between the forming and drying fabrics of a papermaking machine. There may be one or more transfer fabrics and one or more rush transfers. The top plane of the transfer fabric is defined by the highest points or knuckles within the fabric. The top surface of the fabric is defined by the sculpted areas of the fabric which the wet web is exposed to or can substantially contact. Topographical or three-dimensional transfer fabrics can contain from about 5 to about 300 impression knuckles per square inch (per 6.45 $cm^2$), more specifically from about 10 to about 150 impression knuckles per square inch, and still more specifically from about 25 to about 75 impression knuckles per square inch. The impression knuckles are raised at least about 0.15 mm above the lowest level within the top surface. Fabric texture or impression knuckles can be imparted by variations in weave structure for woven fabrics. During molding, the web is macroscopically rearranged to conform to the top surface of the fabric. These same descriptions can be applied to throughdrying fabrics.

Suitable woven fabrics are disclosed in U.S. Patent Application No. US2003/0157300 A1 published Jan. 6, 2004 to Burazin et al, and U.S. Pat. No. 5,746,887 issued May 5, 1998 to Wendt et al, both herein incorporated by reference. The transfer fabrics particularly useful for purposes herein have textured sheet-contacting surfaces comprising substantially continuous machine-direction ridges separated by valleys and are similar to those described the aforementioned Burazin et al. application. Furthermore, such fabrics with ridged sculpted layers can be extended to include ridges having a height of from about 0.4 to about 5 millimeters, a ridge width of about 0.5 millimeters or greater and a cross-machine direction ridge frequency of from about 1.5 to about 8 per centimeter. Additional topographical fabrics with MD dominant features which can be utilized are described in U.S. Patent Application No. 2003/0084953 A1 published on May 8, 2003 to Burazin et al., herein incorporated by reference.

The throughdrying fabric can also be three-dimensional as described above, or it can be relatively flat as in macroscopically monoplanar. Further, throughdrying fabrics useful for purposes of this invention include those that have alternating raised and lowered topographic elements that are not primarily oriented in the machine direction. During throughdrying, the web is dried to a moisture content of about 7 weight percent or less, more specifically about 5 percent or less, more specifically about 3 percent or less, more specifically from about 0.5 to about 3 percent, more specifically from about 1 to about 3 percent and still more specifically from about 1 to about 2 percent. The low moisture content enhances the effectiveness of the subsequent mechanical softening operation.

After the throughdrying operation, the resulting sheet is creped, meaning the sheet is transferred and adhered to the surface of a rotating cylinder and dislodged from the surface by contact with a doctor blade. The cylinder can further dry the sheet, and hence a Yankee dryer can serve as the creping cylinder, but this is optional in that the cylinder need not further dry the sheet. It is advantageous that the throughdrying fabric be used to transfer the sheet to the creping cylinder so that registration of the sheet with the throughdrying fabric pattern, and hence high caliper, is maintained. Transfer to an intermediate fabric would cause loss of registration and could cause a reduction of caliper when the web is transferred to the creping cylinder. It is particularly advantageous for the creping to be carried out at a low sheet moisture content, particularly about 5 percent moisture or less. The lower the moisture content, the more effective the creping will be. A moisture content of from about 1 to about 2 percent at the creping blade is particularly suitable and, for that reason, some drying capability for the creping cylinder can be advantageous.

Adhesion of the sheet to the creping cylinder can be accomplished with the use of a suitable creping adhesive, which can be applied to the surface of the creping cylinder by any suitable method, such as spraying. Particularly suitable creping adhesives include standard creping adhesives such as polyvinyl alcohol, Kymene®/sorbitol mixtures and latex adhesive. Creping imparts improved softness to the sheet by further reducing stiffness and increasing the number of fiber ends that protrude from the surface.

Hence, the softness of the tissue sheets of this invention can be further characterized by the Plate Stiffness (hereinafter defined) and the Fuzz-On-Edge value (hereinafter defined). The Plate Stiffness is a comprehensive measure of sheet stiffness which closely approximates in-use stiffness. The Fuzz-On-Edge value is a measure of a surface component of softness. The Plate Stiffness of the tissue sheets of this invention can be about 1.50 or less, more specifically from about 0.50 to about 1.50, more specifically from about 0.90 to about 1.50 and still more specifically from about 0.90 to about 1.10. The Fuzz-On-Edge value of the tissue sheets of this invention, as measured on the creped side of the sheet (the creping cylinder surface-contacting side), can be about 1.50 or greater, more specifically from about 1.50 to about 1.70, more specifically from about 1.50 to about 1.60.

The tissue sheets of this invention can be layered or nonlayered (blended). Layered sheets can have two, three or more layers. For paper sheets that will be converted into a single-ply product, it can be advantageous to have three layers with the outer layers containing primarily hardwood fibers and the inner layer containing primarily softwood fibers. Tissue sheets in accordance with this invention would be suitable for all forms of tissue products for consumer and services markets including, but not limited to, bathroom tissue, kitchen towels, facial tissue, table napkins and the like.

Furthermore, to be commercially advantaged, it is desirable to minimize the presence of pinholes in the sheet. The degree to which pinholes are present can be quantified by the Pinhole Coverage Index, the Pinhole Count Index and the Pinhole Size Index, all of which are determined by an optical test method known in the art and described in U.S. Patent Application No. US 2003/0157300 A1 to Burazin et al. entitled "Wide Wale Tissue Sheets and Method of Making Same", published Aug. 21, 2003, which is herein incorporated by reference. More particularly, the "Pinhole Coverage Index" is the arithmetic mean percent area of the sample surface area, viewed from above, which is covered or occupied by pinholes. For purposes of this invention, the Pinhole Coverage Index can be about 0.25 or less, more specifically about 0.20 or less, more specifically about 0.15 or less, and still more specifically from about 0.05 to about 0.15. The "Pinhole Count Index" is the number of pinholes per 100 square centimeters that have an equivalent circular diameter (ECD) greater than 400 microns. For purposes of this invention, the Pinhole Count Index can be about 65 or less, more specifically about 60 or less, more specifically about 50 or less, more specifically about 40 or less, still more specifically from about 5 to about 50, and still more specifically from about 5 to about 40. The "Pinhole Size Index" is the mean equivalent circular diameter (ECD) for all pinholes having an ECD greater than 400 microns. For purposes of this invention, the Pinhole Size Index can be about 600 or less, more specifically about 500 or less, more specifically from about 400 to about 600, still more specifically from about 450 to about 550.

DETAILED DESCRIPTION OF THE DRAWING

Figure 1:
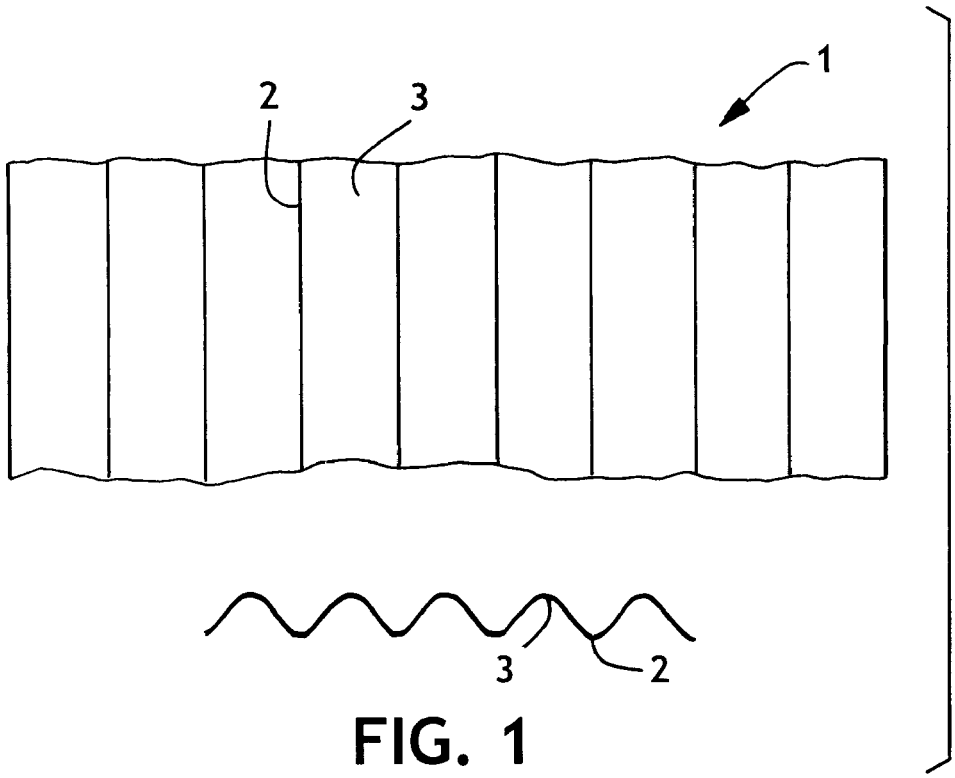
FIG. 1 is a schematic illustration of a molded web having a three-dimensional surface consisting of longitudinal ridges.

Referring to FIG. 1, shown is a portion of a wet tissue web 1 in plan view and cross-section. The series of parallel lines 2 in the plan view represent valleys running in the machine direction of the web. The centers 3 of the areas between the parallel lines represent machine direction ridges. The sinusoidal three-dimensionality of the web is clearly illustrated in the partial cross-section.

Figure 2:
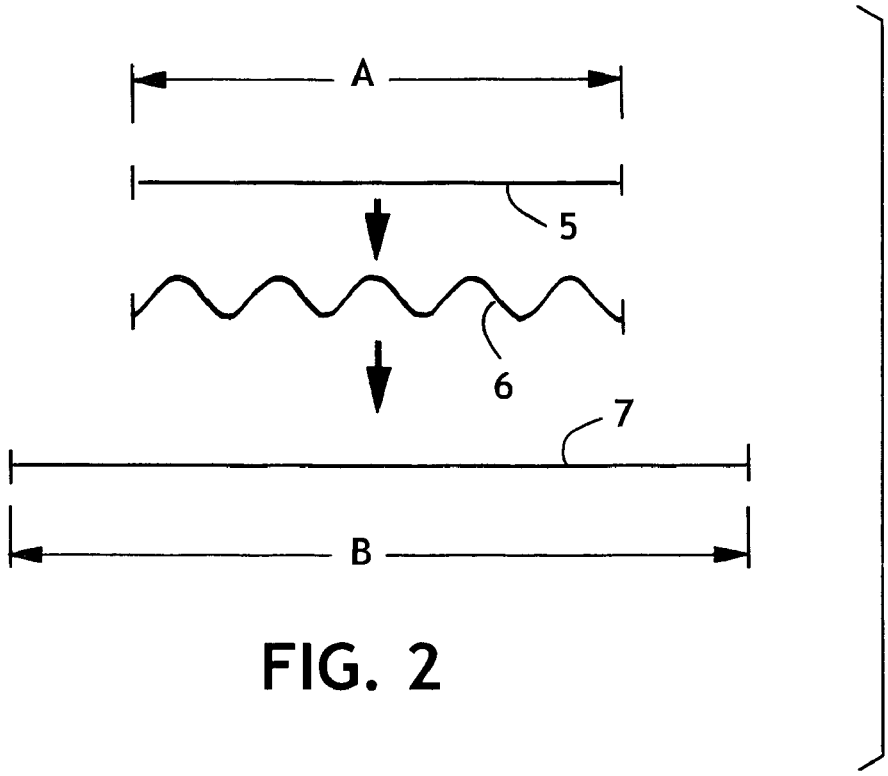
FIG. 2 is a schematic diagram illustrating the measurement of molding strain.

FIG. 2 conceptually illustrates the measurement of molding strain. Shown are three cross-sectional views of a wet tissue web. Dimension "A" represents the cross-sectional width or path length of a flat web 5 prior to molding. After molding, the molded web 6 has the same overall cross-sectional width "A", but now has a three-dimensional surface contour. The curvilinear path length of the three-dimensional surface contour is dimension "B", which is the curvilinear path length of the web converted to a straight line path length after the web is conceptually "flattened" or "pulled out" without further increasing the strain. The degree of molding strain, expressed as a percent, is $[(B-A)/A)]\times 100$. As illustrated, the degree of molding strain is only measured with regard to the overall web contour, ignoring any micro-features on surface of the web that might be contributed to individual protruding fibers.

Test Methods

For purposes herein, tensile strength may be measured using an Sintech tensile tester using a 3-inch jaw width (sample width), a jaw span of 2 inches (gauge length), and a crosshead speed of 25.4 centimeters per minute after maintaining the sample under TAPPI conditions for 4 hours before testing. The "MD tensile strength" is the peak load per 3-inches of sample width when a sample is pulled to rupture in the machine direction. Similarly, the "CD tensile strength" represents the peak load per 3-inches of sample width when a sample is pulled to rupture in the cross-machine direction. The geometric mean tensile strength (GMT) is the square root of the product of the machine direction tensile strength and the cross-machine direction tensile strength of the web. The "CD stretch" and the "MD stretch" are the amount of sample elongation in the cross-machine direction and the machine direction, respectively, at the point of rupture, expressed as a percent of the initial sample length.

More particularly, samples for tensile strength testing are prepared by cutting a 3 inch (76.2 mm) wide by at least 4 inches (101.6 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strength is an MTS Systems Sintech Serial No. 1G/071896/116. The data acquisition software is MTS TestWorks® for Windows Ver. 4.0 (MTS Systems Corp., Eden Prairie, Minn. 55344). The load cell is an MTS 25 Newton maximum load cell. The gauge length between jaws is 2±0.04 inches (76.2±1 mm). The jaws are operated using pneumatic-action and are rubber coated. The minimum grip face width is 3 inches (76.2 mm), and the approximate height of a jaw is 0.5 inches (12.7 mm). The break sensitivity is set at 40%. The sample is placed in the jaws of the instrument, centered both vertically and horizontally. To adjust the initial slack, a pre-load of 1 gram (force) at the rate of 0.1 inch per minute is applied for each test run. The test is then started and ends when the force drops by 40% of peak. The peak load is recorded as either the "MD tensile strength" or the "CD tensile strength" of the specimen depending on the sample being tested. At least 3 representative specimens are tested for each product, taken "as is", and the arithmetic average of all individual specimen tests is either the MD or CD tensile strength for the product.

As used herein, the "geometric mean tensile strength" is the square root of the product of the MD tensile strength multiplied by the CD tensile strength, both as determined above, expressed in grams (force) per 3-inches of sample width.

As used herein, "geometric mean slope", which is a measure of the flexibility of the sheet, is the square root of the product of the machine direction tensile slope multiplied by the cross-machine direction tensile slope and is expressed in kilograms per 3 inches of sample width. The tensile slope is the average slope of the load/elongation curve resulting from the test method described above measured over the range of 70-157 grams (force).

As used herein, the sheet "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the sheet "bulk" is calculated as the quotient of the "caliper", expressed in microns, divided by the dry basis weight, expressed in grams per square meter. The resulting sheet bulk is expressed in cubic centimeters per gram.

As used herein, cross-machine direction "molding strain" is measured by surface profiling techniques such as stylus profilometry. Optical surface topography measurements may also be used. One example of such device is the MicroProf® made by Fries Research and Technology GMBH of Bergisch Gladbach, Germany. Strain values represent the path length of molded tissue relative to the flat (unmolded) distance of the same projected area as illustrated in FIGS. 1 and 2. For tissue sheets, it is important to note that the resolution of the path length measurement is on the order of 100 micrometers (μm). For this purpose, individual cellulose fibers (with diameters on the order of 10 μm) protruding from the molded structure are typically not detectible at this resolution. The path length therefore is a measure of the molded structure, and not the micro roughness of a tissue surface. Molding strains can be measured independently in both the machine and cross-machine direction as well as on an overall level based on a three-dimensional rather than two-dimensional analysis.

As used herein, the Fuzz-On-Edge test is an image analysis test. The image analysis data are taken from two glass plates made into one fixture. Each plate has a sample folded over the edge with the sample folded in the CD direction and placed over the glass plate. Because of the creping process of this invention, the creped side (dryer surface side) of the tissue was analyzed for Fuzz-On-Edge. Uncreped control samples were analyzed for Fuzz-On-Edge on the air-side (the side of the tissue opposite the throughdrying fabric surface). The glass plates that the tissue was placed over have thicknesses of ¼ inch. The beveled edges of the plates have thicknesses of 1/16 inch. During testing, samples are placed over beveled edges. Multiple images of the folded edges are then taken along the edge. Thirty (30) fields of view are examined on each folded edge to give a total of sixty (60) fields of view. Each view has "PR/EL" measured before and after removal of protruding fibers. "PR/EL" is perimeter per edge-length examined in each field of view. "PR" is the perimeter around the protruding fibers while "EL" is the length of the measured sample. The PR/EL values are averaged and assembled into a histogram as an output page. This analysis is completed and the data is obtained using the QUANTIMET 970 Image Analysis System obtained from Leica Corp. of Deerfield, Ill. The image analysis routine and example images can be found in U.S. Pat. No. 6,607,638 B2 issued Aug. 19, 2003 to Drew et al., which is hereby incorporated by reference.

As used herein, the "Plate Stiffness" test is a measure of stiffness of a flat sample as it is deformed downward into a hole beneath the sample. For the test, the sample is modeled as an infinite plate with thickness "t" that resides on a flat surface where it is centered over a hole with radius "R". A central force "F" applied to the tissue directly over the center of the hole deflects the tissue down into the hole by a distance "w". For a linear elastic material the deflection can be predicted by:

$$w = \frac{3F}{4\pi E t^3}(1-\nu)(3+\nu)R^2$$

where "E" is the effective linear elastic modulus, "v" is the Poisson's ratio, "R" is the radius of the hole, and "t" is the thickness of the tissue, taken as the caliper in millimeters measured on a stack of 5 tissues under a load of about 0.29 psi. Taking Poisson's ratio as 0.1 (the solution is not highly sensitive to this parameter, so the inaccuracy due to the assumed value is likely to be minor), the previous equation can be rewritten for "w" to estimate the effective modulus as a function of the flexibility test results:

$$E \approx \frac{3R^2}{4t^3}\frac{F}{w}$$

The test results are carried out using an MTS Alliance RT/1 testing machine (MTS Systems Corp., Eden Prairie, Minn.) with a 100N load cell. As a stack of five tissue sheets at least 2.5-inches square sits centered over a hole of radius 15.75 mm on a support plate, a blunt probe of 3.15 mm radius descends at a speed of 20 mm/min. When the probe tip descends to 1 mm below the plane of the support plate, the test is terminated. The maximum slope in grams of force/mm over any 0.5 mm span during the test is recorded (this maximum slope generally occurs at the end of the stroke). The load cell monitors the applied force and the position of the probe tip relative to the plane of the support plate is also monitored. The peak load is recorded, and "E" is estimated using the above equation.

The Plate Stiffness "S" per unit width can then be calculated as:

$$S = \frac{Et^3}{12}$$

and is expressed in units of Newtons-millimeters. The Testworks program uses the following formula to calculate stiffness:

$$S = \left(\frac{F}{w}\right)\left[\frac{(3+\nu)R^2}{16\pi}\right]$$

wherein "F/w" is max slope (force divided by deflection), "v" is Poisson's ratio taken as 0.1, and "R" is the ring radius.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

EXAMPLES

To further illustrate the invention, a pilot tissue machine was configured similarly to that illustrated in U.S. Pat. No. 5,593,545 issued Jan. 14, 1997 to Rugowski et al. (herein incorporated by reference) and was used to produce a one-ply, uncreped throughdried tissue basesheet. This machine configuration was used to produce the four control codes (Examples 1-4). The same pilot tissue machine was configured to allow for creping of the uncreped throughdried tissue in accordance with this invention (Examples 5-10). As described previously, the tissue web was maintained in registration with the throughdrying fabric as it was pressed onto the creping cylinder.

Raw materials for this trial included 100 pounds of bleached northern softwood kraft fibers dispersed in a pulper for 10 minutes at a consistency of 3 percent. Similarly, 200 pounds of bleached eucalyptus fibers were also dispersed in a pulper for 10 minutes at a consistency of 3 percent. The thick stock was then blended and sent to a machine chest and diluted to a consistency of about 1 percent.

The machine chest furnish was diluted to approximately 0.1% consistency and delivered to a forming fabric using a three-layered headbox. In all controls and examples of this invention, the furnish of all three layers was identical. The forming fabric speed was approximately 62 fpm. The resulting web was then transferred to a transfer fabric traveling at approximately 50 fpm. A flat and a topographical transfer fabric were used during this trial. The flat fabric had the topography of a typical forming fabric such as a Voith Fabrics 2164. The topographic fabric of this example was provided by a woven structure with approximately 13 raised machine-direction-oriented ridges per inch. The cross-machine direction molding strain of the transfer fabric was approximately 15% as measured by a stylus profilometer. At a second vacuum shoe-assisted transfer, the web was delivered onto a throughdrying fabric. The examples presented incorporate both low and high topography transfer fabrics and throughdrying fabrics. The product from the low topography throughdrying fabric had approximately 7% strain in the cross-machine direction while the product from the high topography throughdrying fabric had approximately 13% strain in the cross-machine direction. All controls and inventive samples were dried to approximately 99% solids in the throughdryer operating at a temperature of approximately 375° C.

The resulting tissue basesheet was produced with an ovendry basis weight of approximately 26 grams per square meter (gsm). The sheet was equilibrated for at least 4 hours in TAPPI standard conditions (73° F., 50% relative humidity) before property testing. All testing was performed on basesheet from the pilot machine without further processing.

EXAMPLE 1

Control

An uncreped tissue sheet was made as described above with a 15% straining transfer fabric and 5% straining throughdrying fabric.

EXAMPLE 2

Control

An uncreped tissue sheet was made as described above with a 15% straining transfer fabric and 13% straining throughdrying fabric.

EXAMPLE 3

Control

An uncreped tissue sheet was made as described above with a 2% straining transfer fabric and 5% straining throughdrying fabric.

EXAMPLE 4

Control

An uncreped tissue sheet was made as described above with a 15% straining transfer fabric and 13% straining throughdrying fabric. Less than 1 pound per ton of Kymene® 557 strength additive was added to this control code.

EXAMPLE 5

Invention

An uncreped tissue sheet was made as described above with a 2% straining transfer fabric and 5% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material. Physical property differences between Examples 5-10 are a result of molding strain differences and Kymene® addition and retention levels.

EXAMPLE 6

Invention

An uncreped tissue sheet was made as described above with a 15% straining transfer fabric and 5% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material.

EXAMPLE 7

Invention

An uncreped tissue sheet was made as described above with a 15% straining transfer fabric and 5% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material.

EXAMPLE 8

Invention

An uncreped tissue sheet was made as described above with a 15% straining transfer fabric and 5% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material.

EXAMPLE 9

Invention

An uncreped tissue sheet was made as described above with a 15% straining transfer fabric and 13% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material.

EXAMPLE 10

Invention

An uncreped tissue sheet was made as described above with a 15% straining transfer fabric and 13% straining throughdrying fabric. After the throughdryer, the tissue was maintained in registration on the throughdrying fabric and pressed onto a heated dryer coated with creping adhesive as described above and creped. To allow for comparison to the control materials, the standard strength additive Kymene® 557 was added to the machine chests. Addition levels of this chemical were adjusted such that the amount of Kymene® retained in the final product was sufficient to increase the strength of the product to near that of the control material.

The results of the foregoing examples are summarized in the Table below. "GM slope" is the geometric mean slope, expressed in kilograms of force per 3 inches of sample width. "GM slope/GM tensile" is the geometric mean slope divided by the geometric mean tensile strength, which is unitless. "Caliper" is expressed in mils (thousandths of an inch). "Bulk" is expressed in cubic centimeters per gram. "MD tensile" is the machine direction tensile strength, expressed in grams of force per 3 inches of sample width. "MD Slope" is the machine direction slope, expressed in kilograms of force per 3 inches of sample width. "MD Slope/MD Tensile" is the ratio of the machine direction slope divided by the machine direction tensile strength, which is unitless. "CD Dry" is the cross-machine direction dry tensile strength, expressed in grams of force per 3 inches of sample width. "CD Slope" is the cross-machine direction slope, expressed in units of kilograms of force per 3 inches of sample width. "GMT" is the geometric mean tensile strength, expressed in units of grams of force per 3 inches of sample width. "Plate Stiffness" is as defined above, expressed in units of Newton-millimeters. "CD Molding Strain" is the cross-machine direction strain measured by stylus profilometry for tissue molded and completely dried on a given fabric.

These results illustrate that the tissue sheets of this invention exhibit exceptional softness and flexibility, while also exhibiting good bulk and strength.

It will be appreciated that the foregoing examples, given for purposes of illustration, are not to be construed as limiting the scope of this invention, which is defined by the following claims and all equivalents thereto.

We claim:

1. A tissue sheet having a geometric mean slope of from about 1.0 to about 3.5 kilograms of force per 3 inches of sample width, a geometric mean tensile strength of from about 350 to about 900 grams of force per 3 inches of sample width and a bulk of from about 15 to about 22 cubic centimeters per gram.

2. The tissue sheet of claim 1 having a geometric mean slope of from about 1.5 to about 3.5 kilograms of force per 3 inches of sample width.

3. The tissue sheet of claim 1 having a geometric mean slope of from about 2.0 to about 3.5 kilograms of force per 3 inches of sample width.

4. The tissue sheet of claim 1 having a geometric mean slope of from about 2.0 to about 3.0 kilograms of force per 3 inches of sample width.

5. The tissue sheet of claim 1 having a geometric mean slope of from about 2.2 to about 3.0 kilograms of force per 3 inches of sample width.

6. The tissue sheet of claim 1 having a geometric mean tensile strength of from about 350 to about 800 kilograms of force per 3 inches of sample width.

TABLE (Physical Properties)

| | MD tensile | MD Slope | MD Slope/ MD Tensile | CD Dry | CD Slope | GMT | Transfer Fabric CD Molding Strain | TAD Fabric CD Molding Strain |
|---|---|---|---|---|---|---|---|---|
| Example 1 (Control) | 928 | 3.57 | 0.0038 | 563 | 5.02 | 723 | 15% | 5% |
| Example 2 (Control) | 630 | 3.00 | 0.0048 | 488 | 5.70 | 554 | 15% | 13% |
| Example 3 (Control) | 1075 | 3.90 | 0.0036 | 760 | 12.69 | 904 | 2% | 5% |
| Example 4 (Control) | 111 | 3.91 | 0.0050 | 469 | 4.28 | 604 | 15% | 13% |
| Example 5 (Invention) | 501 | 1.52 | 0.0030 | 381 | 6.18 | 437 | 2% | 5% |
| Example 6 (Invention) | 436 | 1.31 | 0.0030 | 324 | 3.71 | 376 | 15% | 5% |
| Example 7 (Invention) | 856 | 1.79 | 0.0021 | 549 | 5.08 | 686 | 15% | 5% |
| Example 8 (Invention) | 923 | 2.03 | 0.0022 | 509 | 4.40 | 686 | 15% | 5% |
| Example 9 (Invention) | 540 | 1.69 | 0.0031 | 353 | 4.40 | 437 | 15% | 13% |
| Example 10 (Invention) | 693 | 1.90 | 0.0027 | 391 | 4.76 | 521 | 15% | 13% |

| | GM slope | GM slope/ GM tensile | Plate Stiffness | Caliper | Bulk | Fuzz-on-Edge MD | Fuzz-on-Edge CD | GM Fuzz-on-Edge |
|---|---|---|---|---|---|---|---|---|
| Example 1 (Control) | 4.23 | 0.0059 | 2.05 | 22.1 | 20.0 | 1.16 | 1.26 | 1.21 |
| Example 2 (Control) | 4.15 | 0.0075 | NM | 21.9 | 19.9 | NM | NM | NM |
| Example 3 (Control) | 7.03 | 0.0078 | NM | 18.5 | 16.8 | NM | NM | NM |
| Example 4 (Control) | 4.09 | 0.0068 | 1.89 | 25.2 | 22.9 | 1.45 | 1.47 | 1.46 |
| Example 5 (Invention) | 3.06 | 0.0070 | NM | 16.4 | 14.9 | NM | NM | NM |
| Example 6 (Invention) | 2.20 | 0.0059 | NM | 19.7 | 17.9 | NM | NM | NM |
| Example 7 (Invention) | 3.02 | 0.0044 | 1.10 | 19.4 | 17.6 | 1.36 | 1.79 | 1.56 |
| Example 8 (Invention) | 2.99 | 0.0044 | 0.94 | 19.2 | 17.4 | 1.56 | 1.70 | 1.63 |
| Example 9 (Invention) | 2.73 | 0.0062 | 1.47 | 23.0 | 20.9 | 1.49 | 1.77 | 1.62 |
| Example 10 (Invention) | 3.01 | 0.0058 | NM | 23.2 | 21.0 | 1.80 | 1.53 | 1.66 |

7. The tissue sheet of claim 1 having a geometric mean tensile strength of from about 375 to about 700 grams of force per 3 inches of sample width.

8. The tissue sheet of claim 1 having a geometric mean tensile strength of from about 400 to about 700 grams of force per 3 inches of sample width.

9. The tissue sheet of claim 1 having a bulk of from about 15 to about 20 cubic centimeters per gram.

10. The tissue sheet of claim 1 having a bulk of from about 18 to about 20 cubic centimeters per gram.

* * * * *